United States Patent [19]

Tsuda et al.

[11] 4,318,611

[45] Mar. 9, 1982

[54] DOCUMENT FEED CONTROL IN AN ELECTROPHOTOGRAPHIC SYSTEM

[75] Inventors: Hiroshi Tsuda, Mitaka; Kiyoshi Miyashita; Masaji Nishikawa, both of Hachioji; Akira Shimizu, Fuchu; Muneo Kasuga, Hachioji, all of Japan

[73] Assignee: Olympus Optical Company Limited, Tokyo, Japan

[21] Appl. No.: 113,689

[22] Filed: Jan. 21, 1980

[30] Foreign Application Priority Data

Feb. 7, 1979 [JP] Japan ..... 54/12326

[51] Int. Cl.[3] ..... G03G 15/00

[52] U.S. Cl. ..... 355/14 SH; 271/265; 355/3 SH

[58] Field of Search ..... 355/3 SH, 14 R, 14 SH, 355/3 R, 50, 51, 48, 49; 271/265

[56] References Cited

U.S. PATENT DOCUMENTS 4,170,414 10/1979 Hubert et al. ..... 355/3 SH 4,171,128 10/1979 Irvine et al. ..... 271/265 X

*Primary Examiner*—Richard L. Moses

*Attorney, Agent, or Firm*—Fleit & Jacobson

[57] ABSTRACT

An electrophotographic apparatus which makes use of a circuit arrangement connected and arranged such that unless a manuscript to be copied passes through a manuscript detector, a gate circuit functions to prevent a copy starting pulse from passing therethrough, thereby preventing initiation of a new copying operation.

4 Claims, 13 Drawing Figures

DOCUMENT FEED CONTROL IN AN ELECTROPHOTOGRAPHIC SYSTEM

BACKGROUND OF THE INVENTION

1. Field of the Invention

This invention relates to an electrophotographic apparatus comprising a manuscript detecting device and a manuscript feeding device. The manuscript detecting device detects the insertion of a manuscript to be copied into the manuscript feeding device and produces a signal for starting the operation of the manuscript feeding device to feed the manuscript and expose it to a scanning light. After a lapse of time, the manuscript detecting device then produces a signal which causes the next manuscript to be exposed to the scanning light.

2. Description of the Prior Art

An electrophotographic apparatus which makes use of a so-called manuscript feeding device operative to expose a manuscript to be copied to a scanning light when it is fed has been known. In general, such kind of electrophotographic apparatus functions to control various operations, such as the starting of the manuscript feeding device, rotation of a photosensitive body (e.g., a photosensitive drum), operation of a developing device, operation of a uniform charging device, operation of a cleaning device or the like in a precise timing on the basis of a manuscript detecting signal for detecting the fact that the manuscript is set to a given position of the manuscript feeding device.

In addition, in such kind of electrophotographic apparatus, it is possible to obtain one copy when the photosensitive drum is rotated by one turn. If the next manuscript is set to a given position of the manuscript feeding device when the photosensitive drum has rotated by one turn, the manuscript detecting signal and a signal produced when the photosensitive drum is rotated by one turn function to start the copying operation of the next manuscript.

As a result, in the case of obtaining respective copies from a plurality of manuscripts, if the manuscripts are set to the given position of the manuscript feeding device in succession, it is possible to continuously obtain a copy in a short time without stopping the rotation of the photosensitive drum.

In the above mentioned electrophotographic apparatus, however, if the manuscript to be copied has a length which is longer than the peripheral length of the photosensitive drum or if two manuscripts are fed with one portion of one of the manuscripts overlapped with the other manuscript or if the manuscript feeding device is clogged with the manuscript, a new copying operation starts when the manuscript detecting device is operative to detect the presence of the manuscript after the photosensitive drum has been rotated by one turn. As a result, if the length of the manuscript is longer than the peripheral length of the photosensitive drum, the useless rear end portion of the manuscript, which is not aligned with the record sheet, is copied. In addition, when two manuscripts are fed with one portion of one manuscript overlapped with the other manuscript or when the manuscript feeding device is clogged with the manuscript, an entirely incomplete copy is formed.

Various kinds of electrophotographic apparatus are capable of obtaining a plurality of copies from an electrostatic latent image produced and maintained on a photosensitive body. If such electrophotographic apparatus makes use of the above mentioned manuscript feeding device, the above mentioned problems exist, resulting in the formation of a number of useless or incomplete copies.

SUMMARY OF THE INVENTION

A primary object of the invention is to provide an electrophotographic apparatus properly constructed such that useless copies are not formed even when a manuscript to be copied has a length which is longer than a given length or even when a manuscript feeding device is clogged with a manuscript.

A feature of the present invention is the provision in an electrophotographic apparatus comprising a manuscript detecting device and a manuscript feeding device, the apparatus being operative to cause the manuscript detecting device to detect the insertion of a manuscript to be copied into the manuscript feeding device and produce a signal for starting the operation of the manuscript feeding device so as to feed the manuscript and expose it to a scanning light and, after a lapse of time, produce a signal which causes the next manuscript to be exposed to the scanning light. Included is a circuit arrangement connected and arranged such that the signal for exposing the next manuscript to the scanning light is made invalid unless the manuscript detecting device detects the front end of the next manuscript, thereby obviating a useless copying operation for an extra portion of the manuscript having a length which is longer than a given length.

Further objects and features of the invention will be fully understood from the following detailed description with reference to the accompanying drawings, wherein:

DETAILED DESCRIPTION OF THE PREFERRED EMBODIMENTS

Figure 1:
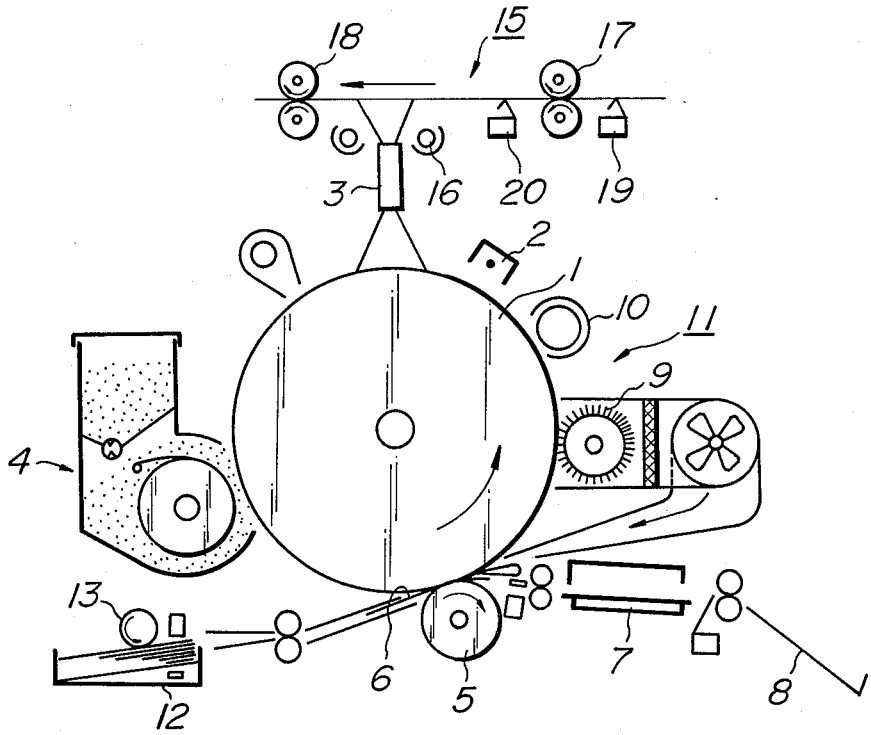
FIG. 1 is a diagrammatic cross-sectional view of one embodiment of an electrophotographic apparatus according to the invention.

FIG. 1 shows one example of essential parts of an electrophotographic apparatus according to the invention. In FIG. 1, a photosensitive drum 1 is rotatably mounted and operative to rotate in a direction shown by an arrow. The photosensitive drum 1 is uniformly charged by a corona discharge device 2 and then illuminated with a light image corresponding to a manuscript image through a projection optical system, in the present embodiment, a selfoclens array 3 to produce an electrostatic latent image corresponding to the manuscript image thereon. This electrostatic latent image is developed into a visible toned image by means of a developing device 4. This toned image is transferred to a record sheet 6 between the photosensitive drum 1 and a transfer roller 5 and then fixed by a fixing device 7 and subsequently delivered as a copy onto a tray 8. After the transfer operation, the residual toned image and electric charge on the photosensitive drum 1 are erased from the surface thereof by the operation of a cleaning device 11 composed of a cleaning brush 9 and an electric charge removing lamp 10, whereby the photosensitive drum 1 becomes ready to produce the next electrostatic latent image thereon. The record sheet 6 is superimposed, one upon the other, in a cassette 12 and fed out one by one in a given timing by means of a record sheet feeding roller 13. The electrophotographic apparatus shown in FIG. 1 can repeat the developing and transfer operations with respect to the electrostatic latent image which has been produced on the photosensitive drum 1 so as to obtain a plurality of copies.

A manuscript to be copied (not shown) is fed along a path in a left direction by a manuscript feeding device 15 in synchronism with the rotation of the photosensitive drum 1. During this feeding operation, the manuscript is illuminated with a light emitted by an exposing lamp 16 and the light image thus obtained is incident through the selfoclens array 3 on the surface of the photosensitive drum 1. The manuscript feeding device 15 is composed of a pair of manuscript feeding rollers 17 rotatably arranged at the inlet side of the manuscript and operative to rotate in a direction shown by an arrow, a pair of manuscript delivering rollers 18 rotatably arranged at the outlet side of the manuscript and operative to rotate in a direction shown by an arrow, a first manuscript detector 19 consisting of a microswitch and arranged in front of the manuscript feeding rollers 17 and a second manuscript detector 20 consisting of a microswitch and arranged in the rear of the manuscript feeding rollers 17, the first and second manuscript detectors 19, 20 being arranged in front of the selfoclens array 3 as viewed in the manuscript feeding direction. The manuscript feeding device 15 is constructed such that, if the first manuscript detector 19 becomes operative by the front end of the manuscript, the manuscript feeding rollers 17 are rotated in a direction shown by an arrow so as to feed the manuscript sandwiched between the rollers 17, 17. If the front end of the manuscript causes the second manuscript detector 20 to operate, the rotation of the rollers 17 is stopped to await the manuscript at this position. In the case of copying the first manuscript, the manuscript is substantially continuously fed, since the manuscript is stopped for a short time only at the position of the second manuscript detector for the purpose of taking timing for the previous step of the photosensitive drum. In the present embodiment, if the second manuscript detector 20 becomes operative, a signal for obtaining a copy starting pulse is produced. This pulse causes a control circuit to operate such that the following operations are controlled in synchronism with the copying operation with a precise timing. That is, the control circuit functions to control a restarting of the manuscript feeding roller 17, lighting up of the lamp 16, rotating of the photosensitive drum 1, operations of the corona discharge device 2, developing device 4, feeding roller 13, transfer roller 5, cleaning device 11 or the like.

In the present embodiment, the manuscript feeding roller 17 functions to start its manuscript feeding operation and continue its rotation until the second manuscript detector 20 becomes OFF. The manuscript delivery roller 18 normally rotates in a direction shown by an arrow when the electrophotographic apparatus is energized from an electric supply source. As a result, all of the manuscript inserted into the manuscript feeding device 15 are always delivered.

In the present embodiment, respective treating devices of the electrophotographic apparatus are controlled as follows.

In the first place, in order to know the rotated angle and number of rotations of the drum 1, a clock pulse is produced by means of a rotary body connected to a driving shaft of the photosensitive drum 1 and provided with a number of holes and a photosenser. 400 clock pulses correspond to one rotation of the drum 1. Secondly, the clock pulse is counted and decoded so as to produce a timing pulse for operating respective treating devices in response to the rotation of the drum 1. In addition, the clock pulses are so combined as to produce a signal for driving respective treating devices. The clock pulse is counted such that the 400th signal is used as an one rotation signal of the drum 1 and also as a signal for resetting its own counter to 0.

The following signals are used for the purpose of starting the copying operation when the manuscript is inserted into the manuscript feeding device or when the manuscript is ready for the copying operation.

1. A pulse produced when the manuscript is inserted into the manuscript feeding device.
2. One rotation signal of the drum 1.

The former pulse is used for the purpose of starting the copying operation when a new manuscript is inserted into the manuscript feeding device at the first time. The latter pulse is used for the purpose of starting the copying operation when the next manuscript is inserted into the manuscript feeding device prior to one rotation of the drum 1 after the copying operation of the first manuscript has been started or when the next manuscript is inserted into the manuscript feeding device in the course of obtaining a plurality of copies from one latent image produced on the drum 1. That is, the former pulse is used for the purpose of immediately starting the copying operation and hence producing the latent image on the drum 1 from any imaginary point thereon as determined when the manuscript is inserted into the manuscript feeding device. The latter pulse is used for the purpose of making the next manuscript ready for its copying operation when the next manuscript is inserted into the manuscript feeding device after the copying operation of the first manuscript and hence obtaining a timing for starting the copying operation with optimum efficiency.

In the electrophotographic apparatus shown in FIG. 1, the peripheral length of the photosensitive drum 1 is made somewhat longer than the maximum length of the record sheet to be allowed by the apparatus. As a result, it is possible to obtain one copy of the manuscript when the drum 1 is rotated by one turn.

In the case of obtaining one copy of the manuscript, after the rear end of the previous manuscript has passed through the second manuscript detector 20, it is possible to make the front end of the next manuscript ready for operating the second manuscript detector 20 and start the copying operation of the next manuscript by means of a copy starting pulse delivered from the control circuit and representing one rotation of the photosensitive drum 1.

Even in the case of obtaining a plurality of copies from one manuscript, after the rear end of the previous manuscript has passed through the second manuscript detector 20, it is possible to make the front end of the next successive manuscript ready for operating the second manuscript detector 20 in succession and start the copying operation of the next successive manuscript by means of a copy starting pulse delivered from the control circuit and representing a number of rotations of drum 1 corresponding to a desired number of copies.

In the electrophotographic apparatus shown in FIG. 1, when the length of the manuscript is longer than the peripheral length of the photosensitive drum 1 or when the next manuscript is fed with its front end overlapped the rear end of the previous manuscript or when the manuscript feeding device 15 is clogged with the manuscript, if the second manuscript detector 20 becomes operative during one rotation of the photosensitive drum 1, the next copying operation is started by the signal representing one rotation of the photosensitive drum 1, whereby there is a risk of a useless copy being formed.

In one embodiment of the invention, a manuscript detecting pulse is produced only when the first manuscript detector 19 is changed from its OFF condition to the ON condition thereof. The manuscript detecting pulse functions to reset a flipflop so as to open a gate which allows to pass a copy starting pulse therethrough. A signal produced when the second manuscript detector 20 becomes ON is supplied as the copy starting pulse to the control circuit. This signal functions to set the flipflop so as to cause the above mentioned gate to be prevented from passing therethrough the copy starting pulse produced in the control circuit until the photosensitive drum 1 is rotated by one turn. In the apparatus constructed as above described, in order to start the next copying operation by the copy starting pulse produced from the control circuit in response to the rotation of the photosensitive drum 1, it is necessary to reset the flipflop by the manuscript detecting pulse produced when the first manuscript detector 19 is changed from its OFF condition to the ON condition thereof, thereby opening the gate. That is, unless the rear end of the previous manuscript is detected, the copying operation of the next manuscript could not be started. Thus, the invention is capable of eliminating the above mentioned disadvantage.

Figure 2:
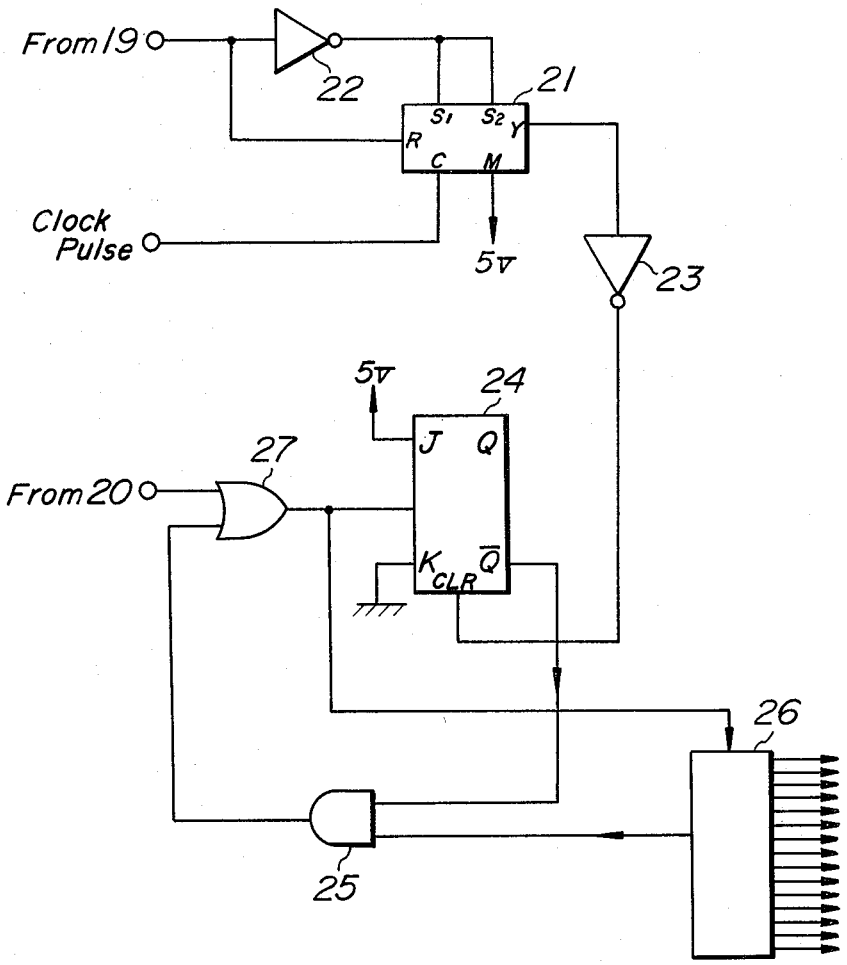
FIG. 2 is a circuit diagram of one embodiment of an electrophotographic apparatus according to the invention.

FIG. 2 shows a circuit arrangement of the present embodiment. In the present embodiment, use is made of an integrated circuit 21 (for example, Ser. No. 74120N) to obtain a manuscript detecting pulse. For this purpose, a signal delivered from the first manuscript detector 19 is directly supplied to an R terminal of the integrated circuit 21 and is supplied through an inverter circuit 22 to $S_1$ and $S_2$ terminals. To a C terminal is supplied a clock pulse. The clock pulse may be obtained from an independent clock pulse generator or from a combination of a suitable member normally energized and rotated by an electric supply source of the electrophotographic apparatus, for example, a disc rotatably interlocked with the drum 1 and provided at its periphery with a suitable number of holes equidistantly separated from each other and a photocoupler. In this way, it is possible to produce one manuscript detecting pulse from a Y terminal of the integrated circuit 21 only when the first manuscript detector 19 is changed from its OFF condition to the ON condition thereof. Alternatively, the manuscript detecting pulse may be produced from a monostable flipflop such, for example, as Ser. No. 74221 or the like when the first manuscript detector 19 is changed from its OFF condition to the ON condition thereof.

Figure 3:
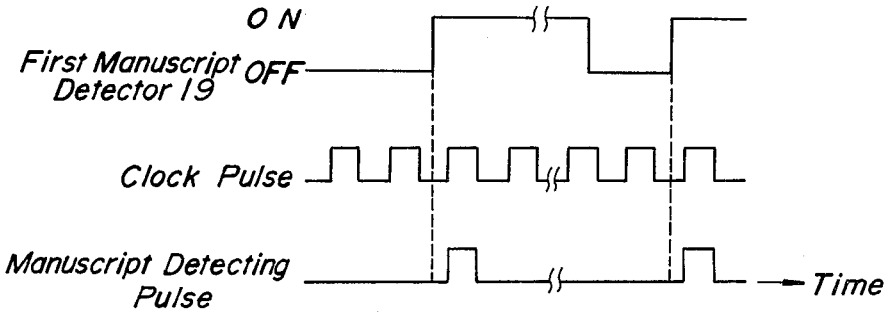
FIG. 3 is a timing diagram for illustrating the operation of an integrated circuit shown in FIG. 2.

FIG. 3 shows a timing chart of the signal delivered from the first manuscript detector 19, clock pulse and manuscript detecting pulse delivered from the Y terminal of the integrated circuit 21.

In the embodiment shown in FIG. 2, the manuscript detecting pulse is supplied through an inverter circuit 23 to a CLR terminal of a flipflop 24 (for example, Ser.No. 74107N). A $\overline{Q}$ output from the flipflop 24 is supplied to a gate circuit 25 so as to control passage of the copy starting pulse produced from the control circuit 26 in response to the rotation of the photosensitive drum 1. The output from the gate circuit 25 is supplied to one of input terminals of an OR circuit 27. To the other input terminal is supplied a copy starting pulse produced when the second manuscript detector 20 becomes ON. The output from the OR circuit 27 is supplied to a set terminal of the flipflop 24 and to a copy starting pulse input terminal of the control circuit 26.

The circuit shown in FIG. 2 will operate as follows. In the first pulse, if a manuscript to be copied is inserted into the manuscript feeding device 15, the first manuscript detector 19 is changed from its OFF condition to the ON condition thereof to produce a manuscript detecting pulse.

The manuscript detecting pulse is supplied to the flipflop 24 so as to clear it, thereby opening the gate circuit 25. At this instant, the photosensitive drum 1 is not yet rotated, so that the copy starting pulse responsive to the rotation of the photosensitive drum 1 is not supplied to the gate circuit 25 from the control circuit 26. As a result, the output from the gate circuit 25 has an L level. Then, the manuscript is fed and its front end arrives at the second manuscript detector 20 to make it ON, thereby producing a copy starting pulse. The copy starting pulse is supplied through the OR circuit 27 to the flipflop 24 so as to set it and directly supplied to the copy starting pulse input terminal of the control circuit 26. As a result, the control circuit 26 becomes operative to control the operation of various parts of the apparatus in synchronism with the copying operation. The copy starting pulse is supplied from the control circuit 26 to the gate circuit 25 when the photosensitive drum 1 is rotated by one turn. But unless the first manuscript detector 19 functions to detect the next manuscript and is changed from its OFF condition to the ON condition thereof, the flipflop 24 is kept under its set condition and the gate circuit 25 is closed, and as a result, the copy starting pulse delivered from the control circuit 26 is prevented from passing the gate circuit 25. On the contrary, if the next manuscript is inserted into the manuscript feeding device 15 so as to change the first manuscript detector 19 from its OFF condition to the ON condition thereof prior to the supply of the copy starting pulse from the control circuit 26 to the gate circuit 25, that is, prior to one rotation of the photosensitive drum 1 after the copying operation for the first manuscript has been started, the flipflop 24 is reset so as to open the gate circuit 25. As a result, the copy starting pulse produced from the control circuit 26 when the photosensitive drum 1 is rotated by one turn passes through the gate circuit 25 and is supplied through the OR circuit 27 to the flipflop 24 so as to set it and to the copy starting pulse input terminal of the control circuit 26. As a result, it is possible to start the copying operation for the next manuscript.

If a plurality of copies are obtaining from the electrostatic latent image produced on the drum 1 when the first manuscript is exposed to the first scanning light, the copy starting pulse is delivered from the control circuit 26 to the gate circuit 25 when the drum 1 has completed its turn corresponding to the final copy. At this instant, if the flipflop 24 has already been reset, the copying operation of obtaining a plurality of copies from the next manuscript or one copy from the next manuscript is started.

If the flipflop 24 is set, that is, if the rear end of the manuscript in the copying operation of obtaining a plurality of copies is not yet passed through the first manuscript detector 19, the copy starting pulse delivered from the control circuit 26 is obstructed by the gate circuit 25, whereby a new copying operation is not started.

Figure 4:
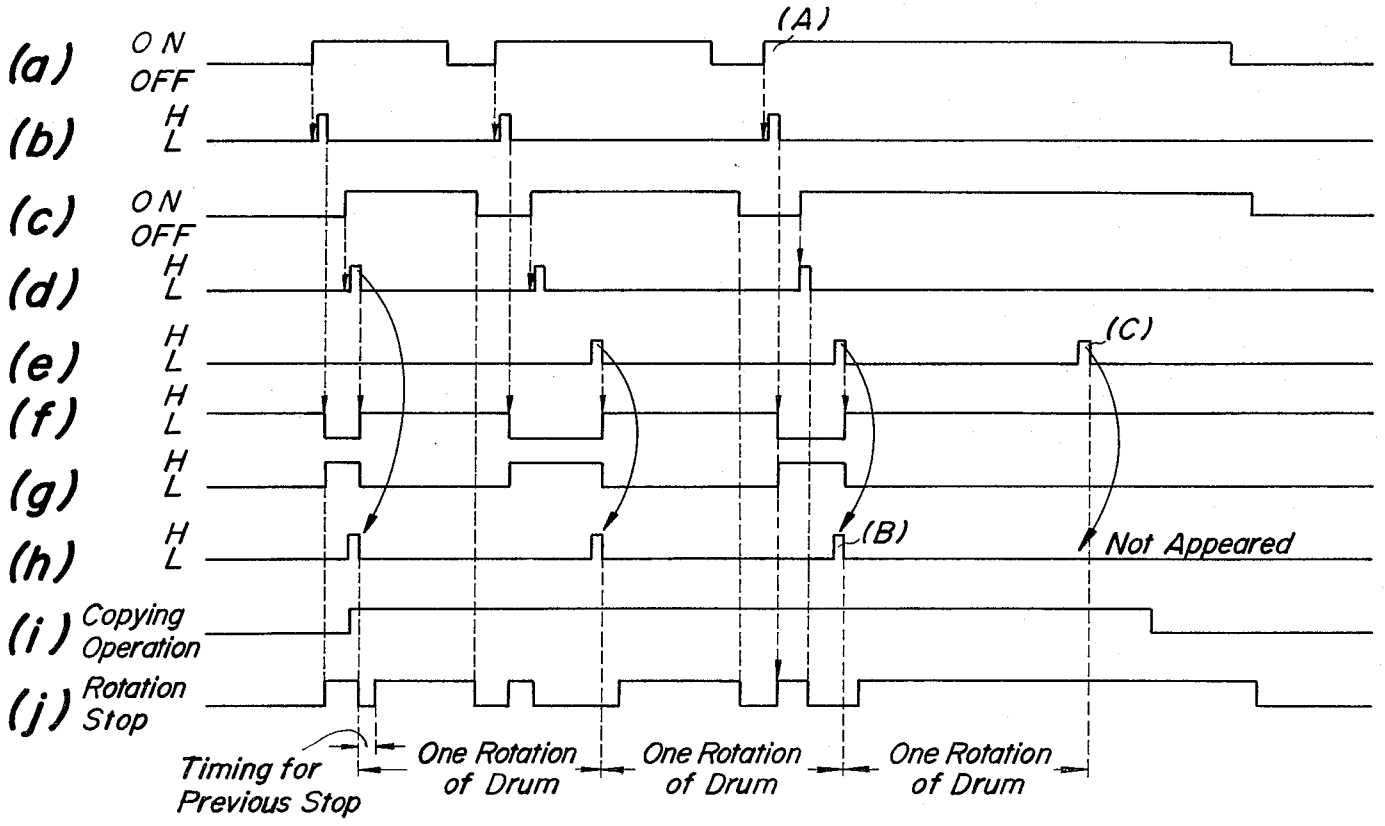
FIGS. 4*a*–4*j* are timing diagrams for illustrating one example of the operation of essential parts of an electrophotographic apparatus according to the invention.

FIG. 4 shows a timing chart illustrating the operation of the essential parts of the embodiment shown in FIG. 2 when it is used for obtaining one copy of these manuscripts, respectively. In FIG. 4, (a) designates a signal delivered from the first manuscript detector 19, (b) shows manuscript detecting pulse delivered from the integrated circuit 21, (c) illustrates a signal delivered from the second manuscript detector 20, (d) designates a copy starting pulse produced when the second manuscript detector 20 is changed from its OFF condition to the ON condition thereof, (e) shows a copy starting pulse supplied from the control circuit 26 to the gate circuit 25 everytime the photosensitive drum 1 is rotated by one turn, (f) illustrates a Q output from the flipflop 24, (g) designates a $\overline{Q}$ output from the flipflop 24, (h) shows a copy starting pulse supplied to the control circuit 26, (i) illustrates a signal representing the copying operation and (j) shows a signal representing the roration and stop of the manuscript feeding roller 17.

In the present embodiment, the length of the third manuscript (A) is longer than the peripheral length of the photosensitive drum. After the copying operation for this third manuscript (A) is started by a copy starting pulse (B), the next copy starting pulse (C) is not appeared as the copy starting pulse. As a result, the useless copying operation is not started at the rear end portion of the third manuscript (A). The manuscript feeding roller 17 is rotated until the second manuscript detector 20 becomes OFF, the third manuscript (A) is effectively delivered out of the manuscript feeding device 15.

As stated hereinbefore, the invention is capable of producing a manuscript detecting pulse only when a manuscript detector is changed from its OFF condition to the ON condition thereof, detecting the rear end of a manuscript, controlling the start of the copying operation on the basis of the manuscript detecting pulse and hence preventing a useless copying operation when the length of the manuscript is longer than a given length or the like.

The invention is not limited to the above mentioned embodiments only, but various changes and alternations may be possible. For example, in the above described embodiment, a manuscript whose length is longer than a given length has completely been delivered out of the manuscript feeding device 15. If the flipflop 24 is reset prior to production of the copy starting pulse responsive to the rotation of the photosensitive drum 1, the long manuscript may intermittently be fed at intervals of given length to obtain copies in succession. In the above embodiment, the invention is applied to an electrophotographic apparatus which can obtain copies by effecting uniform charging, light image illuminating, developing and transferring operations with respect to the photosensitive drum. The invention may also be applied to various other electrophotographic apparatuses such as apparatus using any other electrophotographic latent image forming step, apparatus using a belt-shaped or screen-shaped photosensitive body or apparatus using an intermediate transfer member interposed between the photosensitive body and the record sheet or the like. In addition, the invention may be applied to an electrophotographic apparatus using one photosensitive body or intermediate transfer member provided with a plurality of given electrostatic latent image forming regions. In the above mentioned embodiment, provision has been made of two manuscript detectors. Alternatively provision may be made of one manuscript detector. For example, the first manuscript detector 19 may be replaced by an electric supply source and manual switch so as to rotate the feeding roller 17 and the insertion of the manuscript is detected by the second manuscript detector 20 so as to stop the feeding roller 17 and then rotate it again after a lapse of time.

The signal shown in FIG. 4(*e*) has been described as the copy starting pulse which is supplied from the control circuit to the gate circuit 25 every time the photosensitive drum 1 is rotated by one turn. As such copy starting pulse, use may be made of a signal produced when a light exposure step (latent image forming step) for a manuscript having a length corresponding to the length of the record sheet has been completed.

What is claimed is:

1. An electrophotographic apparatus having a manuscript feed path and for duplicating a plurality of successively fed manuscripts, said apparatus comprising:

manuscript exposing means arranged on the manuscript feed path for illuminating and scanning a manuscript to be duplicated;

manuscript feeding means for feeding the manuscript along the manuscript feed path in a given direction through said manuscript exposing means to effect an illuminating and scanning of the manuscript;

manuscript detecting means arranged on the manuscript feed path at an upstream position relative to the manuscript exposing means when viewed in the manuscript feeding direction to produce a manuscript detection signal;

control means for initiating a duplicating operation for a first manuscript among the plurality of said successively fed manuscripts in response to the manuscript detection signal generated by said manuscript detecting means upon detection of said first manuscript, and for initiating a duplicating operation for each of subsequent manuscripts in response to the manuscript detection signal of the relevant manuscript and a copy starting signal which is produced in accordance with the duplicating operation for the immediately preceding manuscript;

means for judging whether the current manuscript detection signal from the manuscript detecting means is that signal generated in response to the manuscript under duplication or that signal generated in response to the relevant manuscript to be duplicated next; and means for inhibiting an initiation of a new duplicating operation when said judging means has judged that the current manuscript detection signal was generated in response to the manuscript under duplication.

2. An electrophotographic apparatus according to claim 1, wherein said copy starting signal is generated during the duplicating operation for the immediately preceding manuscript so that formation of an electrostatic charge image corresponding to said relevant manuscript can be initiated.

3. An electrophotographic apparatus according to claim 1, wherein said manuscript feeding means remains operative so as to discharge the manuscript under duplication even when the judging means has judged that said current manuscript detection signal was that generated in response to the manuscript under duplication.

4. The electrophotographic apparatus according to claim 1, wherein said manuscript detecting means comprises a manuscript detecting switch and an integrated circuit having input terminals one of which is connected to said manuscript detecting switch and the other of which is connected to a clock pulse generator and an output terminal for delivering said manuscript detecting signal; said judging means comprises a flip-flop having a CLR terminal connected to said output terminal of the integrated circuit and an OR circuit having two input terminals one of which is coupled with said manuscript detecting means, and an output terminal connected to a set terminal of said flip-flop; and said inhibiting means comprises a gate circuit having two input of which is connected to a Q terminal of said flip-flop and the other input terminal is connected to said control means to receive said copy starting signal which is produced in response to the rotation of a photosensitive drum, and an output terminal connected to the other input terminal of said OR circuit.

* * * * *